United States Patent [19]

Langen et al.

[11] Patent Number: 4,510,620

[45] Date of Patent: Apr. 9, 1985

[54] HANDLE FOR CARRIER BAG AND METHOD OF MAKING HANDLED CARRIER BAG

[76] Inventors: Marinus J. M. Langen, 21 Chilcot Ave., Rexdale, Ontario, Canada, M9W 1T9; Edgars H. Strauss, deceased, late of Scarborough, Canada; by Leida Strauss, administrator, 125 Hildenboro Sq., Scarborough, Ontario, Canada, M1W 1Y2

[21] Appl. No.: 469,748

[22] Filed: Feb. 25, 1983

[30] Foreign Application Priority Data

Feb. 23, 1982 [CA] Canada ..... 396889

[51] Int. Cl.[3] ..... B65D 33/12

[52] U.S. Cl. ..... 383/14; 53/413; 428/134; 493/221

[58] Field of Search ..... 383/14, 20; 53/413; 428/107, 131, 134; 493/221, 226; 229/52 A, 52 AC, 52 AL

[56] References Cited

U.S. PATENT DOCUMENTS

| | | | |
|---|---|---|---|
| 2,075,672 | 3/1937 | Stark | 383/20 |
| 3,053,434 | 9/1962 | Atwood | 383/20 |
| 3,283,993 | 11/1966 | McLean | 383/20 |
| 3,722,377 | 3/1973 | Hayes | 493/226 |
| 4,148,431 | 4/1979 | Lepisto | 383/14 |
| 4,184,413 | 1/1980 | Langen et al. | 493/228 |

FOREIGN PATENT DOCUMENTS

| | | | |
|---|---|---|---|
| 1441785 | 5/1966 | France | 383/20 |
| 817220 | 7/1959 | United Kingdom | 383/14 |
| 1157112 | 7/1969 | United Kingdom | 383/20 |

*Primary Examiner*—Stephen P. Garbe

*Attorney, Agent, or Firm*—Fetherstonhaugh & Co.

[57] ABSTRACT

A handle for a carrier bag comprising an elongated band of flexible material having a high tensile strength, said band having a pair of arm portions which extend to opposite ends of a bridge portion which extends therebetween, a mounting panel having a mounting face secured to said arm portions and said bridge so as to initially retain said arm portions and said bridge in a substantially coplanar relationship in which said arm portions extend in a first direction, said mounting panel projecting laterally from said arms so as to be mountable on a wall of a carrier bag to secure said band thereto in said coplanar relationship, said mounting panel being severable to release said bridge portion to permit movement thereof relative to said arms.

3 Claims, 5 Drawing Figures

HANDLE FOR CARRIER BAG AND METHOD OF MAKING HANDLED CARRIER BAG

This invention relates to carrier bags and handles therefor.

In particular, this invention relates to a handle for a carrier bag, a carrier bag incorporating a handle and a method of manufacturing the handle and the carrier bag.

PRIOR ART

Considerable difficulty has been experienced in attempting to provide handles in inexpensive carrier bags. Conventional paper bags of the type used for packaging grocery items are inexpensive to manufacture provided they do not include a handle. Plastic bags are commonly formed with a hand opening adjacent an upper edge thereof. When the hand opening is located below the upper edge of the container, the storage capacity of the container is automatically reduced. When the hand opening is located above the upper edge of a container portion a substantial amount of the web from which the bag is formed is removed as scrap material.

The inexpensive paper such as Kraft paper from which paper bags are commonly made does not have sufficient inherent strength to permit the formation of hand openings in the body of the bag without providing some form of reinforcement. One of the difficulties which have been experienced in attempting to apply handle elements to a paper bag is that these tend to interfere with the manufacture and handling of the paper bags.

We have found that the handle for a carrier bag can conveniently be manufactured from an elongated band of flexible material which is secured to a sidewall of a bag by means of a mounting panel so that the band is initially retained in a position in which it does not constitute an obstruction, the mounting panel being severable to release a portion of the band to form a handle in use.

According to one aspect of the present invention a handle for a carrier bag comprises, an elongated band of flexible material having a high tensile strength, said band having a pair of outer leg portions which extend to opposite ends of a bridge portion which extends therebetween, a mounting panel having a mounting face secured to said outer leg portions and said bridge so as to initially retain said outer leg portions and said bridge in a substantially coplanar relationship in which said outer leg portions extend in a first direction, said mounting panel projecting laterally from said outer leg portions so as to be mountable on a wall of a carrier bag to secure said band thereto in said coplanar relationship, said mounting panel being severable to release said bridge portion to permit movement thereof relative to said outer leg portions, said mounting panel being in the form of a substantially rectangular frame having an aperture opening therethrough, said frame having a first pair of oppositely disposed sections and a second pair of oppositely disposed sections, said outer legs being secured one to each of said first pair of oppositely disposed sections and said bridge portion being secured to one of said second sections, at least a portion of said one of said second sections being severable from said mounting panel to release the bridge portion to form a manually engageable handle in use.

According to a further aspect of the present invention there is provided, in a carrier bag which has a container portion having a pair of oppositely disposed side walls each having an upper edge; the improvement of; a handle which comprises; an elongated band of flexible material having a high tensile strength, said elongated band being initially arranged in an M-shaped configuration having a pair of outer leg portions and a V-shaped bridge portion which extends therebetween, a mounting panel having a mounting face secured to said outer leg portions and to the lower end of the V-shaped bridge portion, said mounting panel also being secured to one of said side walls in a position in which it initially retains the elongated band in its M-shaped configuration and in which the M-shaped configuration extends downwardly from said upper edge of said side wall, said mounting panel being severable on both sides of lower end of the V-shaped bridge portion to release the bridge portion to permit it to extend upwardly from said upper edge to form a manually engagable handle.

The invention will be more clearly understood after reference to the following detailed specification read in conjunction with the drawings wherein.

Figure 1:
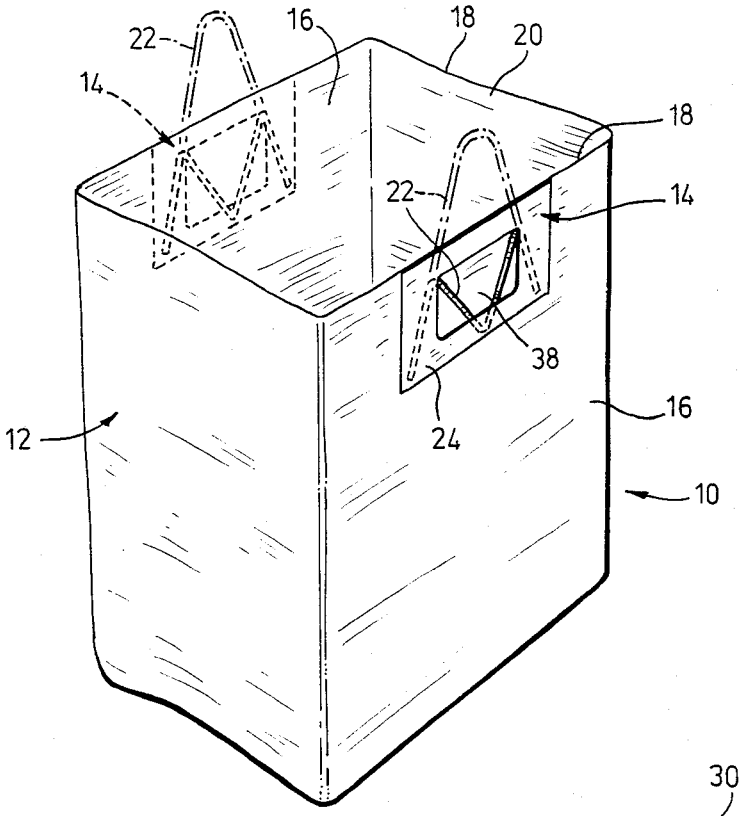
FIG. 1 is a pictorial view of a carrier bag constructed in accordance with an embodiment of the present invention.

With reference to FIG. 1 of the drawings, reference numeral 10 refers generally to a carrier bag which consists of a carrier portion 12 and a pair of handle portions 14. The container portion 12 has a pair of oppositely disposed sidewalls 16 which extend from upper edges 18 located at the open upper end 20. The container portion 12 may be formed from any suitable carrier bag forming material. The handles 14 of the present invention are, however, particularly suitable for use in association with a container bag formed from an expensive Kraft paper or the like in a method of manufacturing a bag such as that described in our U.S. Pat. No. 4,184,413 dated Jan. 22, 1980.

The handle 14 comprises an elongated band of flexible material 22 which is, preferably, a type such as a Sesame Hot Melt tape RS0 236 manufactured by Sesame Industries Limited of Montreal. Tapes of this type are used for the purposes of reinforcing handles in other fields, such as in beer cartons and the like. The band of flexible material 22 is bondable to the sidewalls 16 of the bag by heating it to effect bonding. The band of flexible material 22 is further secured to the sidewall 16 by a mounting panel 24. The mounting panel 24 has side panels 26, an upward panel 28 and a lower panel 30. The band 22 is initially disposed in an M-shaped configuration, as shown by the broken lines in FIG. 2. In this configuration, the band has outer leg portions 32 which are disposed between the sidewall 16 of the bag and the side panels 26 of the mounting panel 24. A bridge portion 34 initially extends downwardly from the upper ends of the outer leg portions 32 as shown in broken lines in FIG. 2 with the base 36 portion thereof underlying a portion 30*a* of the lower panel 30. A window opening 38 opens through the mounting panel 24 so that the bridge portion of the band 22 is visible when in the position shown in FIG. 1. The mounting panel 24 is, preferably, made from paper such as Kraft paper and has an adhesive coating applied to its inner face which serves to secure it in a face-to-face relationship with respect to the sidewalls 16 of the bag. The mounting panel 24 serves to retain the bridge portion 34 in a close face-to-face relationship with the sidewalls 16 in a position extending downwardly from the upper edge 18 so that the flexible band 22 does not project outwardly from the surface or edges of the container during shipping and initial handling.

Figure 2:
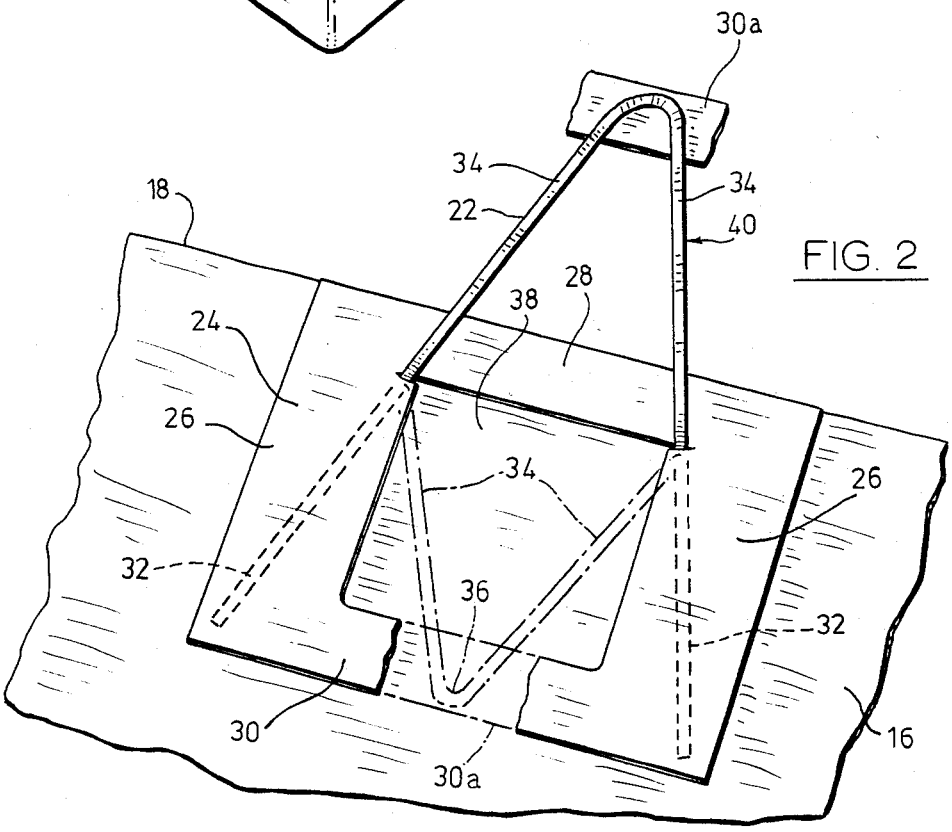
FIG. 2 is an enlarged detailed view of one handle of the bag of FIG. 1.

In order to form a manually engageable handle 40 it is merely necessary to tear the base portion 36 of the bridge portion 34 away from its securement with respect to the sidewall 16. This may be achieved by severing the portion 30*a* of the lower panel 30 as shown in FIG. 2 so that the bridge portion 34 is free to extend upwardly beyond the upper edge 18.

We have found that a handle constructed in this manner and attached to a container in this manner has remarkable strength characteristics. When the flexible band is located in the position to provide the manually engageable hand portion 40, as illustrated in FIG. 2, the V-shaped configuration of the bridge portion 34 is aligned with the outer leg portion 32 and this contributes to the strength characteristics of the handle. When loaded, the major portion of the weight load is applied axially along the length of the legs 34 and 32 with little or no peeling forces being applied at the interfaces between the sidewalls 16 and legs 32 and side panels 26.

Figure 3:
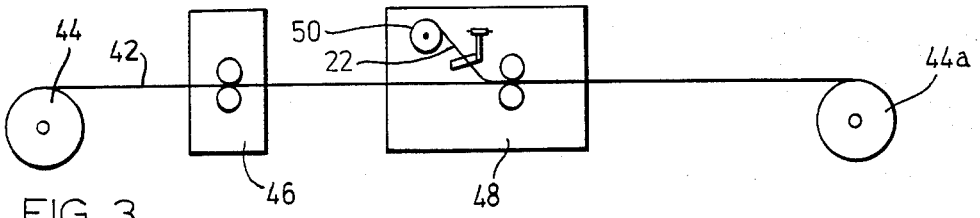
FIG. 3 is a diagrammatic representation of an apparatus for applying an elongated band of flexible material to a plurality of mounting panels.
Figure 4:
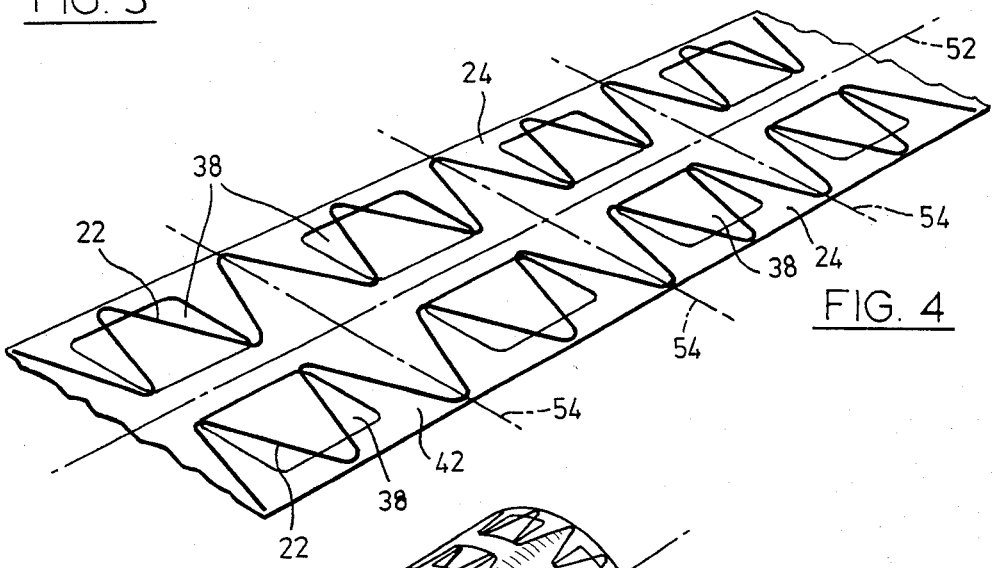
FIG. 4 is a pictorial plan view of a length of handle-forming web.

One method of manufacturing a handle panel will now be described with reference to FIGS. 3 and 4 of the drawings. An elongated web 42 is unwound from a coil 44 and passes through a punching station 46 wherein the window openings 38 are formed. The web, then, passes through a band mounting station 48 in which a pair of bands 22 are unwound from a coil 50 and applied in a zig-zag pattern to the surface of the web 24. The position of the bands 22 in relation to the windows 38 of the web 24 is as shown in FIG. 4 of the drawings. The bands 22 are each sealed to the web 24 and recoiled in a coil 44*a*.

Figure 5:
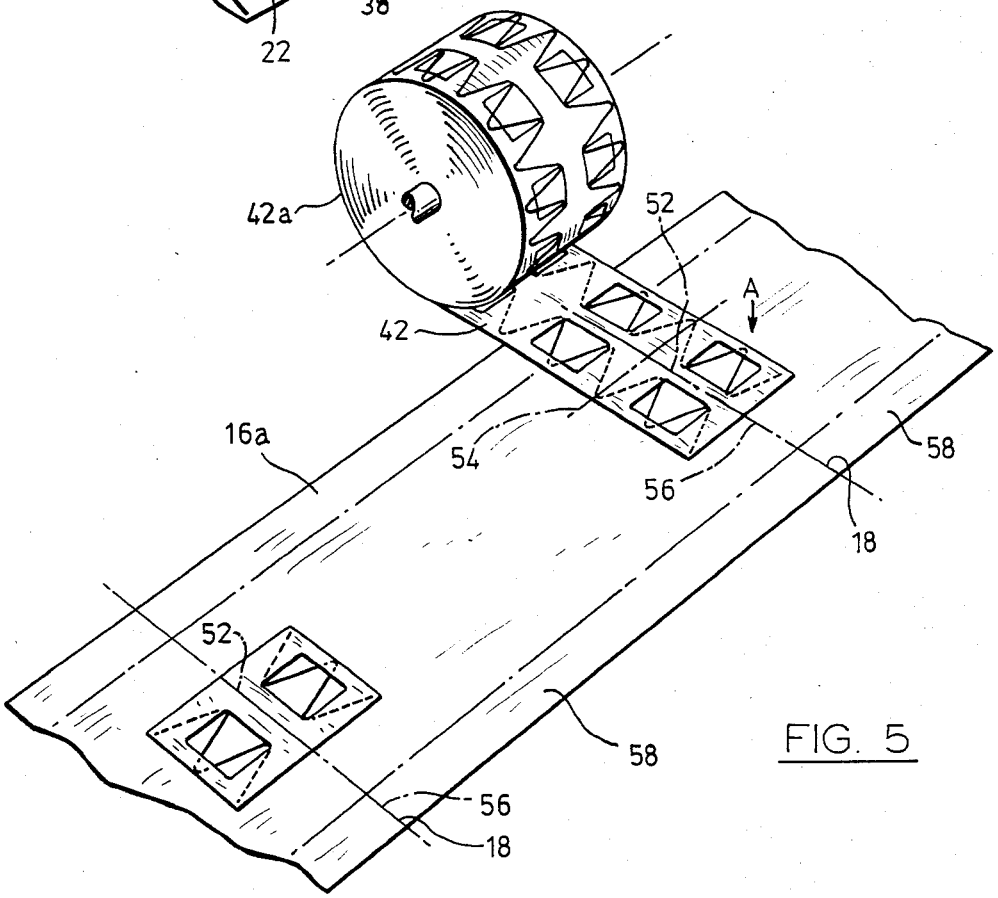
FIG. 5 is a pictorial view illustrating the manner in which the handle members are located on a length of bag-forming material.

As shown in FIG. 5 of the drawings, the coil 44*a* is, then, arranged to dispense handle-forming lengths onto a continuous web 16*a* of container-forming material of the type used in the manufacture of bags in our U.S. Pat. No. 4,184,413 dated Jan. 22, 1980. The handle panels are bonded to the face of the web 16*a* by a heat sealing process or the like. The web 42 is severed along the line 54 and directed downwardly in the direction of the arrow A such that the centre line 52 of the web 42 is aligned with the plane 56 along which individual bag lengths 58 will subsequently be separated from the web 16*a*. The plane 56*a* is the plane along which the upper edges 18 of each container sidewall 16 will be formed in a bag making operation such as that of our prior U.S. Pat. No. 4,184,413 dated Jan. 20, 1980. In this configuration, it will be noted that the W-configuration of the flexible band 16 is inverted in relation to the upper edge 18.

From the foregoing, it will be apparent that the present invention provides a simple and inexpensive bag handle which, when secured to a container such as a paper bag, will serve to retain the handle-forming band in close proximity to the sidewall of the bag during manufacture and handling of the bag while permitting a portion of the flexible band member to be released to form a manually engageable handle projecting above an upper edge of the bag as required in use.

We claim:

1. In a carrier bag which has a container portion having a pair of oppositely disposed side walls each having an upper edge; the improvement of;

a handle comprising;

(a) an elongated band of flexible material having a high tensile strength, said elongated band being initially arranged in an M-shaped configuration having a pair of outer leg portions and a V-shaped bridge portion which extends therebetween, (b) a mounting panel having a mounting face secured to said outer leg portions and to the lower end of the V-shaped bridge portion, said mounting panel also being secured to one of said side walls in a position in which it initially retains the elongated band in its M-shaped configuration and in which the M-shaped configuration extends downwardly from said upper edge of said side wall, said mounting panel being severable on both sides of lower end of the V-shaped bridge portion to release the bridge portion to permit it to extend upwardly from said upper edge to form a manually engagable handle.

2. A handle for a carrier bag comprising, (a) an elongated band of flexible material having a high tensile strength, said band having a pair of outer leg portions which extend to opposite ends of a bridge portion which extends therebetween, (b) a mounting panel having a mounting face secured to said outer leg portions and said bridge so as to initially retain said outer leg portions and said bridge in a substantially coplanar relationship in which said outer leg portions extend in a first direction, said mounting panel projecting laterally from said outer leg portions so as to be mountable on a wall of a carrier bag to secure said band thereto in said coplanar relationship, said mounting panel being severable to release said bridge portion to permit movement thereof relative to said outer leg portions, (c) said mounting panel being in the form of a substantially rectangular frame having an aperture opening therethrough, said frame having a first pair of oppositely disposed sections and a second pair of oppositely disposed sections, said outer legs being secured one to each of said first pair of oppositely disposed sections and said bridge portion being secured to one of said second sections, at least a portion of said one of said second sections being severable from said mounting panel to release the bridge portion to form a manually engageable handle in use.

3. A handle forming stock comprising, (a) an elongated web having a pair of longitudinally extending mounting faces arranged in a side-by-side relationship, each of said mounting faces having a pair of oppositely disposed marginal edge portions extending in said longitudinal direction, (b) a pair of elongated bands of flexible material having a high tensile strength, said bands being secured one on each mounting face, in a zig-zag configuration, so as to provide a plurality of transversely extending apices, the apices of one band being transversely aligned with and oppositely disposed with respect to the apices of the other band, said web being transversely severable at longitudinally spaced intervals to form a pair of handle forming panels each having a W-shaped band portion and said web being longitudinally severable to separate the handle portions in use.

* * * * *